United States Patent [19]

Sloan

[11] Patent Number: 4,889,180

[45] Date of Patent: Dec. 26, 1989

[54] SYSTEM FOR USE IN PROVIDING COMPRESSED AIR FOR SNOW MAKING EQUIPMENT

[75] Inventor: Mark D. Sloan, Harris County, Tex.

[73] Assignee: Brunner Engineering & Manufacturing Inc., Houston, Tex.

[21] Appl. No.: 338,189

[22] Filed: Apr. 14, 1989

[51] Int. Cl.[4] ..... F25B 29/00; A01G 15/00; E01H 13/00

[52] U.S. Cl. ..... 165/30; 165/39; 165/47; 165/61; 165/65; 239/14.2; 239/128; 239/129; 62/74; 62/347; 417/243

[58] Field of Search ..... 165/39, 47, 61, 65, 165/30; 239/2.2, 14.2, 129, 128; 62/347, 74; 417/243

[56] References Cited

U.S. PATENT DOCUMENTS

| | | | |
|---|---|---|---|
| 2,676,471 | 4/1954 | Pierce, Jr. | 239/2.2 |
| 3,494,559 | 2/1970 | Skinner | 239/2.2 |
| 4,036,432 | 7/1977 | George | 165/39 |
| 4,190,205 | 2/1980 | Mitchell | 239/129 |
| 4,194,689 | 3/1980 | Ash | 239/14.2 |
| 4,214,700 | 7/1980 | Vanderkelen et al. | 239/2.2 |
| 4,545,529 | 10/1985 | Tropeano et al. | 239/2.2 |
| 4,573,636 | 3/1986 | Dilworth et al. | 239/2.2 |
| 4,597,524 | 7/1986 | Albertsson | 239/14.2 |
| 4,682,729 | 7/1987 | Doman et al. | 239/2.2 |
| 4,746,064 | 5/1988 | Isono et al. | 62/74 |

FOREIGN PATENT DOCUMENTS

| | | | |
|---|---|---|---|
| 1095449 | 12/1960 | Fed. Rep. of Germany | 417/243 |
| 1372024 | 8/1964 | France | 239/14.2 |
| 1337626 | 9/1987 | U.S.S.R. | 239/2.2 |

*Primary Examiner*—John Ford
*Attorney, Agent, or Firm*—Head & Johnson

[57] ABSTRACT

A system for use in providing compressed air for snow making equipment used in conjunction with a liquid cooled air compressor, including a plurality of motor driven fans and a heater coil assembly positioned in a portion of the path of the air moved by each of the fans, the heater coil assembly having a liquid coolant flowing therethrough, an air-to-air heat exchanger positioned adjacent the heater coil assembly and in the air flow paths of the fans, the air-to-air heat exchanger being connected in series with the air compressor and the snow making equipment and serving to reduce the temperature of the compressed air flowing from the compressor to the snow making equipment, actuator controlled louvers positioned above the air-to-air heat exchanger, there being one louver for each fan, a liquid cooling coil assembly supported adjacent the air-to-air heat heat exchanger and in a separate air flow path, a liquid transfer pump for moving cooling liquid from the compressor and a control assembly which may be a manually controlled valve for passing coolant liquid from the compressor through both the heater coil assembly and the liquid cooling coil assembly in portions as regulated by the control equipment and controls responsive to the air temperature at the outlet of the air-to-air heat exchanger to control the louvers and the fans to provide the required outlet temperature of the compressed air from the air-to-air heat exchanger for optimum snow making requirements.

3 Claims, 1 Drawing Sheet

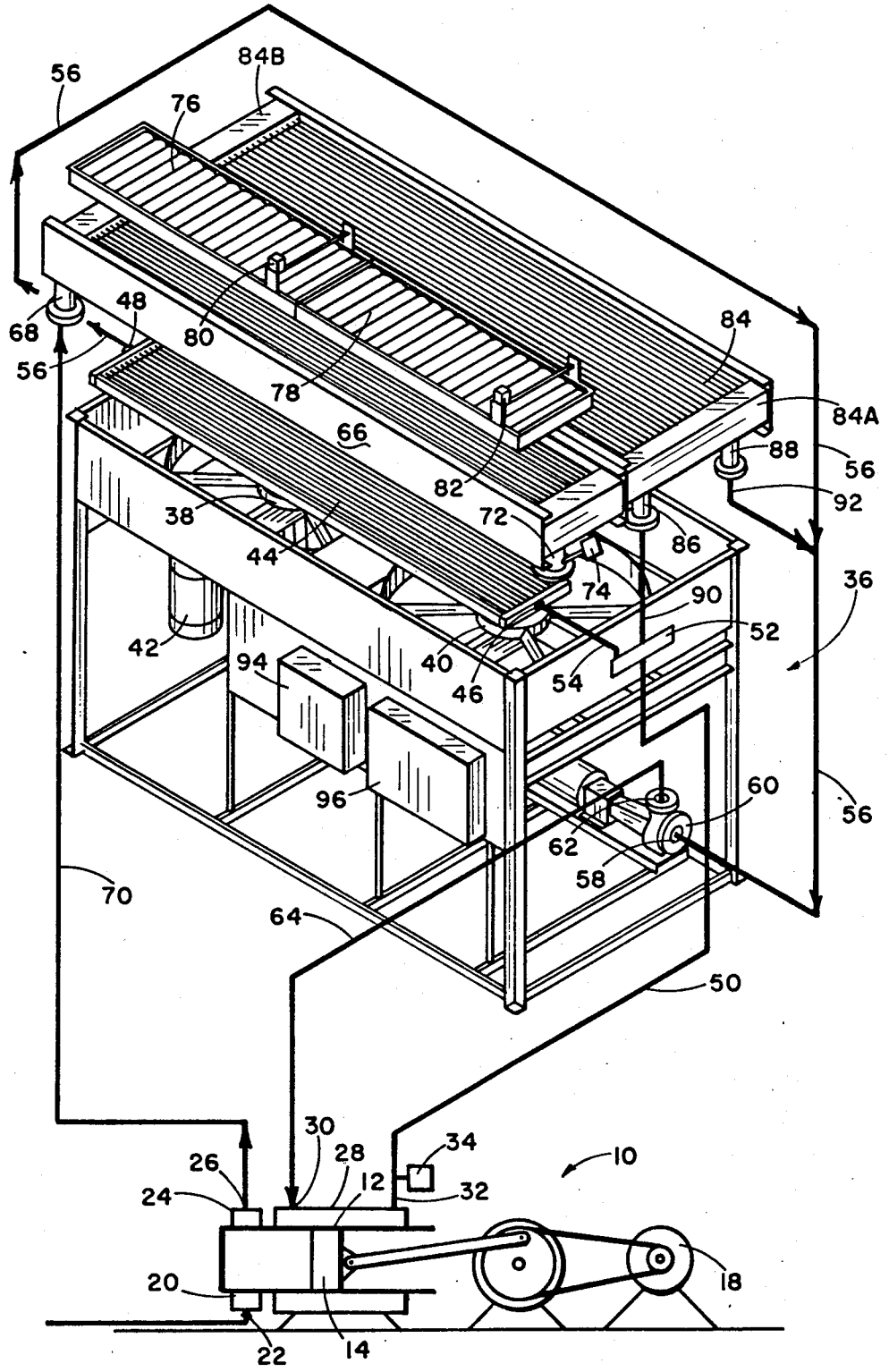
56
84B
76
68
48
80
56
78
84
84A
66
88
56
82
92
38
72
86
44
74
36
90
42
52
94
40
46
54
96
60
56
62
58
70
64
50
30
34
26
28
10
24
12
32
20
18
22
14

SYSTEM FOR USE IN PROVIDING COMPRESSED AIR FOR SNOW MAKING EQUIPMENT

SUMMARY OF THE INVENTION

An exceedingly popular recreational activity in the United States and in many other parts of the world today is that of skiing. Unfortunately, many areas which have sufficient snow to produce skiing conditions during some parts of the season do not have dependable snow fall to ensure good skiing conditions at all times throughout the season. For this reason, in recent years the use of artificial snow making equipment has dramatically increased. Artificial snow is used to augment natural snow so as to produce more idealized conditions during the regular snow season and for extending the length of the skiing season.

Artificial snow is typically made by equipment utilizing compressed air and water. For reference to apparatus which uses air and water for manufacturing snow see U.S. Pat. Nos. 4,214,700; 4,194,689; 4,682,729; 4,545,529; 4,573,636; 3,494,559; and 2,676,471. Generally, snow is made by expelling cold, compresed air through a nozzle from which water vapor is injected so that the water is converted by the compressed cold air to snow. The use of compressed air is, of course, advantageous in manufacturing snow since as the pressure of compressed air is released as it is injected through a nozzle, the temperature of the compressed air falls and when co-mingled with the water vapor forms the natural conditions under which snow is created. For this reason, most snow making equipment utilizes large volumes of compressed air along with water for manufacturing snow.

When air is compressed, the temperature thereof is increased. This generates two problems in conjunction with the use of large air compressors. First, the compressor itself must be cooled and for this purpose most large air compressors typically include built in intercoolers and/or aftercoolers and a compressor lube oil exchanger, all of which will be referred to generally as a water jacket in which liquid coolant is circulated around the air compressor cylinders. The second problem is that of cooling the compressed air to a temperature more compatible with manufacturing snow. The present invention is directed to a system for use in conjunction with an air compressor for accomplishing these two results, that is, cooling the compressed air to the ideal temperature for snow making and cooling liquid utilized for circulation in the air compressor water jacket.

The equipment used in practicing the invention is in the form of a superstructure resting on the earth's surface. A plurality of motor driven fans are supported by the superstructure. The fans are preferably placed in line and in a common plane and each provides an air flow path. A heater coil assembly is positioned above the fans so that at least a portion of the air moved by the fans passes through the heater coil assembly. The heater coil assembly has a cooling liquid inlet and a cooling liquid outlet.

An air-to-air heat exchanger is positioned above the heater coil assembly and so that the air moved by the fans through the heater coil assembly moves through the air-to-air heat exchanger. The air-to-air heat exchanger has an air inlet which receives air from the air compressor and an air outlet which is connected to snow making equipment. A temperature probe is placed in the outlet of the air-to-air heat exchanger to sense the outlet process temperature. Actuator controlled louvers are positioned above the air-to-air heat exchanger, there being one louver for each fan and each louver is positioned in the path of air passing through the heater coil assembly and air-to-air heat exchanger.

A liquid cooling coil assembly is supported by the superstructure and positioned adjacent the air-to-air heat exchanger and above the fans to receive the flow of air from the fans by means of separate air flow paths. The liquid cooling coil assembly has a liquid inlet and a liquid outlet.

Also supported by the superstructure is a liquid transfer pump having an inlet and outlet. The outlet of the transfer pump is connected to the air compressor cooling liquid inlet to thereby circulate cooling liquid through the compressor water jacket to thereby cool the compressor. A control valve assembly or other comparable means such as a manually operated valve is utilized for conveying a selectable portion of the cooling liquid from the air compressor cooling liquid outlet to the heater coil assembly and for conveying a selectable portion of the cooling liquid from the air compressor cooling liquid outlet to the liquid cooler coil assembly inlet. The proportions of the cooling liquid passing through the heater coil assembly is determined by the temperature of air at the air-to-air heat exchanger outlet. When the ambient air temperature is below a certain level so that the compressed air at the outlet of the air-to-air heat exchanger is below that which is desired for snow making, cooling liquid from the air compressor is circulated through the heater coil assembly to warm the air to the temperature range for snow making. When the temperature of air at the outlet at the air-to-air heat exchanger is at/or above the ideal temperature for snow making, the control valve assembly functions to terminate flow of fluid through the heater coil assembly.

In general, the air temperature cannot be at or below 32° F., or the freezing point of water within the heat exchanger, otherwise moisture in the air will freeze and collect, which can "freeze up" or plug the heat exchanger. For this reason, it is important that the air exiting the heat exchanger be slightly above the point at which water vapor in the air will freeze.

The flow of fluid through the liquid cooling assembly is controlled such as to maintain the temperature of the air compressor at/or below a selected maximum level.

Further, control equipment is provided to control the louvers associated with each fan and to close the louvers to reduce the air flow through the air-to-air heat exchanger as necessary to maintain the desired temperature of air passing out of the air-to-air heat exchanger. Such control equipment also functions to control the individual motors of the fans so that as minimum temperatures of the air passing out of the air-to-air heat exchanger reaches a minimum of 32° F., the louvers are fully closed and power to the motors is removed as required to control the compressed air temperature passing to the snow making equipment to that which is within the range of the desired temperature for maximum snow making effectiveness.

Thus, the system of this invention functions in conjunction with a liquid cooled air compressor system for regulating the temperature of the compressed air supplied to snow making equipment, and, at the same time, regulating the temperature of the liquid coolant for use in cooling the compressor in an arrangement wherein the system functions to take maximum advantage of the energy being employed to compress the air for greatest efficiency in producing ideal compressed air temperature for snow making.

A better understanding will be had of the invention with reference to the following specification of the preferred embodiment taken in conjunction with the attached drawings.

Description of the Drawing

The drawing is an isometric exploded view of a system for producing compressed air for use in snow making equipment, some of the system being shown diagrammatically.

Description of the Preferred Embodiment

Referring to the drawing, an air compressor for use in producing compressed air for use in snow making equipment is indicated by the numeral 10, the air compressor being shown diagrammatically. The air compressor includes a cylinder 12 with a piston 14 therein actuated by a crank arm 16 which in turn is driven by a motor 18. The cylinder 12 has an inlet valve 20 having an air inlet 22. The cylinder also has an outlet valve 24 with an air outlet 26. Surrounding the cylinder 12 is a water jacket by which the air compressor is cooled. The water jacket has a liquid coolant inlet 30 and a liquid coolant outlet 32. A thermostatic valve 34 is affixed in piping 32 thus regulating the temperature of the liquid coolant outlet.

The basic compressor type described to this point is not part of the system of this invention, but is illustrated and described to establish the environment in which the system of this invention is typically employed. Obviously, the air compressor may be of a completely different type than that illustrated merely for purposes of exemplification. The only significant aspect of the structure 10 is that it provides at the air outlet 26 a large volume of compressed air which typically has a temperature which exceeds the temperature ideal for snow making and which utilizes liquid coolant which, under most conditions, must be cooled to maintain the operating temperature of the compressor. The system of this invention works in conjunction with an air compressor system which is exemplified by the numeral 10 to accomplish the dual function of controlling the temperature of the compressed air to that which is required under ambient conditions for making snow and for controlling the temperature of the liquid coolant circulating in compressor water jacket 28.

For this purpose the system includes a superstructure generally indicated by the numeral 36 which is made up of structure members in the normal mechanical engineering arrangement for supporting the apparatus making up the system of the invention. Supported by this superstructure 36 are a plurality of fans two being shown, that is, fans 38 and 40. The fans 38 and 40 have horizontally extending blades. The fans are in line with each other and the fan blades rotate in a common horizontal plane. Each of the fans is driven by a motor, the motor of fan 38 being shown and identified by the numeral 42. Fan 40 has a like motor, but is not illustrated since its position is obscured by other equipment.

Supported on the superstructure above fans 38 and 40 is a heater coil assembly 44. The heater coil assembly 44 is a typical heat exchanger of the type for exchanging heat between a liquid and moving air, in this case ambient air as moved by fans 38 and 40. Heater coil assembly 44 typically includes a plurality of long, thin walled tubular members with a header at each end and functions in the manner of a typical radiator. The heater coil assembly 44 has a liquid inlet 46 and a liquid outlet 48.

Extending from the compressor liquid coolant outlet 32 is piping 50 which is connected with a control valve assembly 52, shown diagrammatically. From the control valve assembly 52, piping 54 connects to the heater coil assembly inlet 46. When the control valve assembly 42 is actuated in a manner which will be described subsequently, at least part of the coolant liquid circulated through the water jacket 28 of the air compressor is passed through the heater coil assembly 44. From the outlet of the heater coil assembly, piping 56 connects to the inlet 58 of a motor driven circulating pipe 60. The pump outlet 62 connects by piping 64 to the liquid coolant inlet 30 of compressor water jacket 28. Thus, when the control valve assembly 52 is actuated in a certain manner, coolant liquid from the compressor is circulated by means of the circulating pump 60 through the heater coil assembly 44.

Supported parallel to and above the heater coil assembly is an air-to-air heat exchanger 66. This heat exchanger has a series of closely spaced tubes connected between headers at each end thereof through which compressed air passes. Ambient air in the flow paths of fans 38 and 40 passes through such tubes to exchange heat with the air within the tubes. At one end of the air-to-air heat exchanger is an air inlet 68 which is connected by piping 70 extending from the compressed air outlet 26. At the header at the opposite end of the air-to-air heat excahnger is a compressed air outlet 72. Piping (not shown) extends to connect compressed air outlet 72 to snow making equipment (not shown). At the compressed air outlet 72, the air under pressure as supplied from compressor 10 has been cooled as required and is ready for use in making snow. Typically, the desired temperature of the compressed air at outlet 72 is a minimum of 32° F. and a maximum of approximately 40° F. Typically, the air passing out of the air compressor at outlet 26 is much higher such as 196° F. The temperature of the air, therefore, must be lowered approximately 156° F. as it passes through the air-to-air heat exchanger 66. This is accomplished by the affect of exchange of heat from the air flowing through the heat exchanger with ambient air as moved by fans 38 and 40. It should be kept in mind that normally snow making will occur when the ambient air temperature is below freezing, that is, below 32° F. since otherwise the snow manufactured would soon be melted. Thus, the snow making equipment typically functions in relatively cold ambient air temperatures. Such cold ambient air is sufficient to reduce the temperature of the compressed air as necessary to lower it to that which is most desirable for snow making. A temperature sensor 74 is positioned in the process outlet air stream to measure the temperature of the compressed air passing out of the air-to-air heat exchanger 68 at outlet 72.

Positioned above the air-to-air heat exchanger 68 are actuator controlled louvers 76 and 78. There is one louver for each fan. In the embodiment illustrated, two fans are used although it can be seen that one, two, three or more fans may be used. Louver 76 is controlled by an actuator 80; and, in like manner, louver 78 is controlled by an actuator 82. The actuators 80 and 82 respond to electrical signals to vary the amount of opening of each of the louvers; and, therefore, the amount of air which is permitted to pass therethrough. As previously noted, FIG. 1 shows the components of the system in exploded view for easy visualization, it being understood that in operation the heater coil assembly 44 is supported directly on top of the superstructure 36 immediately above the fans 38 and 40 and that the air-to-air heat exchanger 66 and louvers 76 and 78 are supported in engagement with each other on top of the heater coil assembly.

Also supported on the superstructure 36 is a compressor jacket cooling liquid assembly 84. The heat exchanger typically has a header at each end and a plurality of tubes extending between the headers. The heat excahnger 84 has a liquid inlet 86 and a liquid outlet 88. The inlet and outlet are shown extending from the same header indicating that the header 84A is divided so that the fluid flowing into the heat exchanger through inlet 36 flows through one-half of the tubes to the opposite header 84B which is also divided so that the fluid flows in one direction through one-half of the tubes extending between the headers in the opposite direction through the other half of the tubes. Having both the inlet and outlet at one header is merely optional, and it can be seen that the same result can be obtained by placing the outlet at header 84B with the headers being undivided and the fluid flowing through the tubes all in one direction.

Piping 90 extends from control valve assembly 52 so that a selectable portion of the liquid coolant flowing from compressor water jacket 28 by way of piping 50 is conducted to the inlet 86. This coolant liquid flows through the heat exchanger, out the outlet 82 and by piping 92 connects with piping 56 so that the fluid is returned to the circulating pump inlet 58.

Supported on the superstructure are two control panels. The first is a temperature control panel 94, and the second, a power control panel 96. Wiring extends from the power control panel 96 to the fan motors and to the circulating pump 60, such wiring not being shown since it is conventional to avoid undue complication of the drawing. In addition, wiring extends from temperature sensor 74, control valve assembly 52, actuator 80 and actuator 82 to the power panel 96 to provide control functions as required. Such wiring is not shown for the reason previously given; that is, it is conventional and would unduly complicate the illustration of the preferred embodiment of the invention.

OPERATION OF THE SYSTEM FOR USE IN PROVIDING COMPRESSED

Air For Snow Making Equipment

With compressor motor 86 energized, compressed air is produced having under usual conditions a relatively high temperature. The compressed flows through piping 70 into the inlet 68 of the air-to-air heat exchanger 66. The temperature of the compressed air is lowered by ambient air moved by fans 38 and 40 through the air-to-air heat exchanger. The compressed air passes out of the exchanger through air outlet 72 and is conducted to snow making equipment. The compressed air has a preselected optimum temperature such as 32° F. to 40° F., it being understood that this optimum temperature will vary according to the particular type of snow making equipment being utilized and ambient air conditions. At the same time, circulating pump 60 circulates cooling fluid from water jacket 28 through the control valve assembly 52 and the compressor jacket cooling liquid assembly 84 to cool the compressor. As long as the temperature of the air passing out of the air-to-air heat exchanger outlet 72 is at or above the desired temperature for snow making, no jacket water cooling liquid flows through the heater coil assembly 44; that is, the control valve assembly 52 functions either manually or in response to signals provided by temperature control panel 94 to close flow through piping 54. However, if the ambient air temperature is so low that the air passing out of the air-to-air heat exchanger outlet 72, as detected by sensor 74 is below the preselected level, and assuming that signals from the control panel has already closed louvers 76 and 78 and shut off motors 38 and 40, as will be described subsequently, control valve assembly 52 functions to direct at least a portion of the circulating water jacket cooling liquid from the compressor by way of piping 54 and through the heater coil assembly 44. This serves to heat the air passing through the air-to-air heat exchanger 66 to raise the temperature of the compressed air during extremely cold weather. Except during extremely cold weather, no liquid normally flows through the heater coil assembly 44.

The louvers 76 and 78 are actuated in response to temperature detected by sensor 74 and signals supplied from control panel 94 to open and close as necessary to provide the desired temperature of the compressed air. A typical sequence is illustrated in the attached chart, the temperatures being that of the compressed air passing through air outlet 72 is determined by detector 74.

| | LOUVER 76 FAN 38 | LOUVER 78 FAN 40 |
|---|---|---|
| Start to close louvers | 40° F. | 38° F. |
| Louvers closed | 34° F. | 32° F. |
| Motor on | 38° F. | 36° F. |
| Motor off | 34° F. | 32° F. |

Since air-to-air heat is exchanged sequentially, first, in the portion of the air-to-air heat exchanger 44 immediately above fan 38 this fan is controlled at a higher temperature than that which controls fan 40. It can be seen that by the sequence of controls, the louvers 76 and 78 and the fan motors 38 and 40 are controlled in sequence such as to maintain the temperature of air in the preselected arrangement of that which is desired for snow making.

Thus, it can be understood that the system disclosure herein provides a compact, unified arrangement for controlling the temperature of air produced by an air compressor for snow making and in an arrangement which simultaneously cools the liquid coolant in the water jacket of the air compressor and which takes advantage of the heat available from the liquid coolant circulated in the water jacket for maintaining the compressed air within the ideal temperature range for snow making.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A system for use in providing compressed air for snow making equipment, the system being used in conjunction with a liquid cooled air compressor, the air compressor having a cooling liquid inlet and a cooling liquid outlet and having a compressed air discharge outlet, the system comprising:

a superstructure supported on the earth's surface;

a plurality of motor driven fans supported by the superstructure, the fans being in line and in a common plane, and providing an air flow path for each fan;

a heater coil assembly positioned adjacent said fans whereby air moved by said fans passes therethrough, the assembly having a cooling liquid inlet and a cooling liquid outlet;

an air-to-air heat exchanger positioned adjacent said heater coil assembly and in said air flow paths of said fans whereby air moved by said fans may pass therethrough, the air-to-air heat exchanger having an air inlet connected to receive compressed air from an air compressor and an air outlet connected to snow making equipment;

an actuator controlled louver positioned adjacent said air-to-air heat exchanger for each fan and in the path of air moved through said heater coil assembly;

a liquid cooling coil assembly supported by said superstructure and positioned adjacent said air-to-air heat exchanger above said fans and in a separate air flow path and having a liquid inlet and a liquid outlet;

a liquid transfer pump having an inlet and an outlet, the outlet being connected to an air compressor cooling liquid inlet;

means of conveying a selectable portion of the cooling liquid from the air compressor cooling liquid outlet to said heater coil assembly and of conveying a selectable portion of the cooling liquid from said air compressor cooling liquid outlet to said liquid cooling coil assembly inlet, the portion conducted to said heater coil assembly being determined by the air temperature at the outlet of said air-to-air heat exchanger; and means to regulate said actuator controlled louvers in response to the temperature of air at the outlet of said air-to-air heat exchanger.

2. A system according to claim 1 wherein said means to regulate said actuator controlled louvers includes means to separately regulate each of said louvers in response to the temperature of air at said outlet of said air-to-air heat exchanger.

3. A system according to claim 1 including a power control means providing separate power to said motor driven fans and including control means for individually starting and stopping said motor driven fans in response to the temperature of air at said outlet of said air-to-air heat exchanger.

* * * * *